US008028994B2

(12) United States Patent
Pececnik

(10) Patent No.: US 8,028,994 B2
(45) Date of Patent: Oct. 4, 2011

(54) GAMING DEVICE AND METHOD OF USE WITH BALLS OF DIFFERING DIAMETERS

(75) Inventor: Joze Pececnik, Trzin (SI)

(73) Assignee: Elektroncek d.d., Menges (SI)

( * ) Notice: Subject to any disclaimer, the term of this patent is extended or adjusted under 35 U.S.C. 154(b) by 598 days.

(21) Appl. No.: 11/470,038

(22) Filed: Sep. 5, 2006

(65) Prior Publication Data

US 2007/0075488 A1 Apr. 5, 2007

(30) Foreign Application Priority Data

Sep. 8, 2005 (SI) ..... P-200500257

(51) Int. Cl.
*A63F 3/06* (2006.01)

(52) U.S. Cl. ..... 273/269; 273/138.1; 273/139; 273/142 E; 273/142 H; 273/142 HA

(58) Field of Classification Search ..... 273/138.1, 273/139, 142 R, 142 H, 142 HA, 142 F, 142 E, 273/143 R See application file for complete search history.

(56) References Cited

U.S. PATENT DOCUMENTS

| | | | | |
|---|---|---|---|---|
| 1,755,730 | A * | 4/1930 | Gosser | 273/243 |
| 2,660,434 | A | 11/1953 | Durant | |
| 3,044,780 | A | 7/1962 | Silverman | |
| 3,853,324 | A * | 12/1974 | Reiner et al. | 273/142 E |
| 5,553,851 | A * | 9/1996 | Malavazos et al. | 273/142 E |
| 5,622,367 | A * | 4/1997 | Hwang | 273/144 A |
| 6,824,463 | B1 * | 11/2004 | Yamaguchi et al. | 463/17 |
| 2006/0249899 | A1 * | 11/2006 | Lease | 273/142 R |

FOREIGN PATENT DOCUMENTS

| | | |
|---|---|---|
| DE | 3716849 | 12/1988 |
| GB | 211283 | 2/1924 |
| GB | 2356576 | 5/2001 |

* cited by examiner

*Primary Examiner* — Gene Kim

*Assistant Examiner* — Joseph B Baldori

(74) *Attorney, Agent, or Firm* — Abelman, Frayne & Schwab

(57) ABSTRACT

A gaming device with orbs for the generation of a greater number of results is disclosed. The device draws out numbers in a single playing cycle in various games where a greater number of orbs are used and the result depends on the numbers that are marked in the openings by randomly laying orbs. The balls are, as a rule, of two dimensions—wherein the balls with the smaller dimensions are in the game for reasons of better scattering and greater attractiveness, while the balls with the greater diameter that represent the result or the drawn numbers are retained in random holes on the plate of the cylinder with the help of the offset plate of the cylinder.

12 Claims, 2 Drawing Sheets

GAMING DEVICE AND METHOD OF USE WITH BALLS OF DIFFERING DIAMETERS

CROSS REFERENCE

This non-provisional utility application claims priority to Slovenian Patent Application No. P-200500257, by inventor Joze Pececnik, titled, Gaming Device With Orbs For The Generation Of A Greater Number Of Results, filed on Sep. 8, 2005, which is incorporated herein by reference.

FIELD OF INVENTION

The present invention generally relates to a gaming device, and more particularly relate to a gaming device with substantially spherical balls where the gaming device can rapidly generate a randomly selected set of the substantially spherical balls, namely by drawing out each set during a single playing cycle within any of various different various games, where a greater diameter balls are used, and where the randomly selected set of the substantially spherical balls are those balls of larger diameter that are found in a respective set of opening in the gaming device.

BACKGROUND

A problem with gaming devices that select a random set of balls is that these devices do not quickly and efficiently scatter the balls, position the balls, select each set, and then preparation for a new game. A reduction of time needed for the drawing of the random set of balls and in a manner that makes the game faster and more attractive to the gamers.

There are a large number of constructions of gaming devices and appliances which make possible the selection of random numbers with the help of stranding the balls or orbs in the marked openings.

The U.S. Pat. No. 5,536,007, for example, describes the construction of a device with one orb which is mounted below a screen with holes. By randomly occupying individual holes marked with numbers, a hit is enabled. The draw back of this device is, in addition to the number of results in a single game being small, the device does not have a simple mechanism provided for the repeated setting up of the device for the next game, thus making this device inappropriate for a large number of players.

U.S. Pat. No. 4,630,822 describes a game where a number of orbs are thrown onto a disc-shaped playing surface with unconnected marked openings. The orbs are then scattered with a special revolving object (a peg top) into the unconnected marked openings each having a different value. This solution is also inappropriate for a large number of players.

The gaming device described in the EP Patent Document No. 1,533,009 features a construction solution in the shape of a box which has stranding mechanisms made on the bottom playing surface that accept the balls or the orbs and laying openings on the top of the playing surface that are covered with special valves that open during the evacuation of the device and enable the drawing out of the balls or orbs—for example, by using a magnet stick with metal orbs.

All the described solutions are designed as gaming devices for a small number of players and are generally inappropriate for a large number of players typical of casino environments.

SUMMARY

In one implementation, a gaming device with balls of differing diameters is provided. In a game played with the device, balls are shot by a generated air current over a spinning cylinder having appropriately marked holes. Balls of two or more dimensions are used. The balls with the smaller dimensions are used in the game to better scatter all of the balls and to provide an attractive game play environment. The balls with a greater diameter are those that are randomly selected to form a set thereof. The spinning cylinder can be made of double plates such that balls with a smaller diameter will pass through the double plates while balls having the larger diameter will be retained in marked spots of the double plates. The larger diameter balls that are retained in the marked spots of the double plates represent the randomly selected set of ball that constitute the result of a game played on the gaming device.

In another implementation, a gaming device has a ball ejection passage extending concentrically through top and bottom plates. Each plate has a plurality of circular holes there through, and the holes in the top plate are respectively associated with marking indicia. The top and bottom plates are being rotatable between an offset and non-offset positions thereof. In the non-offset position, both smaller and larger diameter substantially spherical balls above the top plate fall by gravity through the circular holes in the top and bottom plates, and larger diameter balls above the top plate are retained respective the holes in the top plate. In the offset position, smaller diameter balls above the top plate fall by gravity through a respective one hole in the top plate and through a respective one hole in the bottom plate, and the larger diameter balls above the top plate are retained respective holes in the top plate. The top plate is generally rotatable relative to the bottom plate. A stepping mechanism can be provided to rotate the top plate relative to the bottom plate between the offset and non-offset positions thereof without manual intervention during play of the gaming device. The balls can be ejected from below the bottom plate to above the top plate through the concentric ball ejection passage by a blower generating air currents.

BRIEF DESCRIPTION OF THE DRAWINGS

A more complete understanding of the implementations may be had by reference to the following detailed description when taken in conjunction with the accompanying drawings wherein.

DETAILED DESCRIPTION

In reading the detailed description, the accompanying Figures may be referenced at the same time and considered as part of the detailed description.

Figure 1:
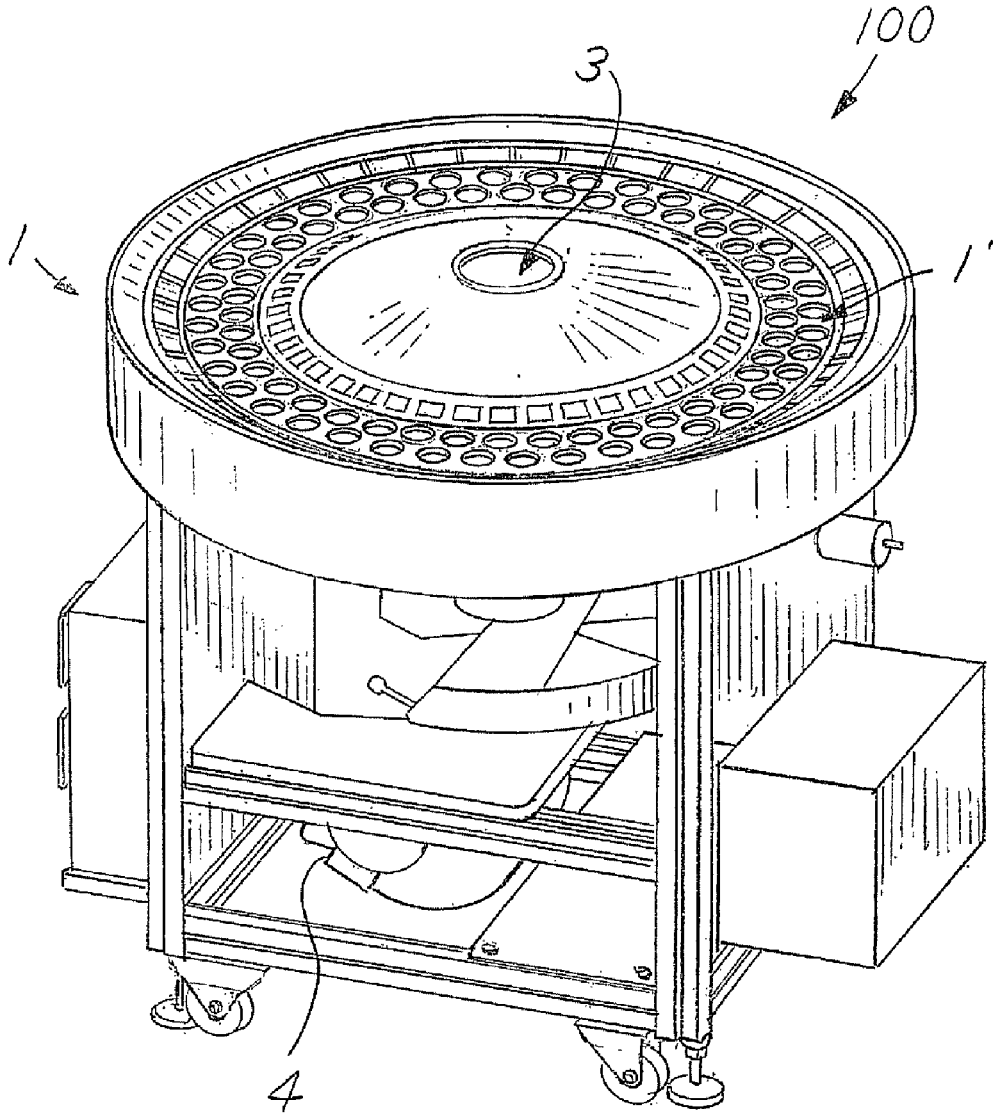
FIG. 1 shows a perspective view of an exemplary implementation of a gaming device with balls of differing diameters.
Figure 2:
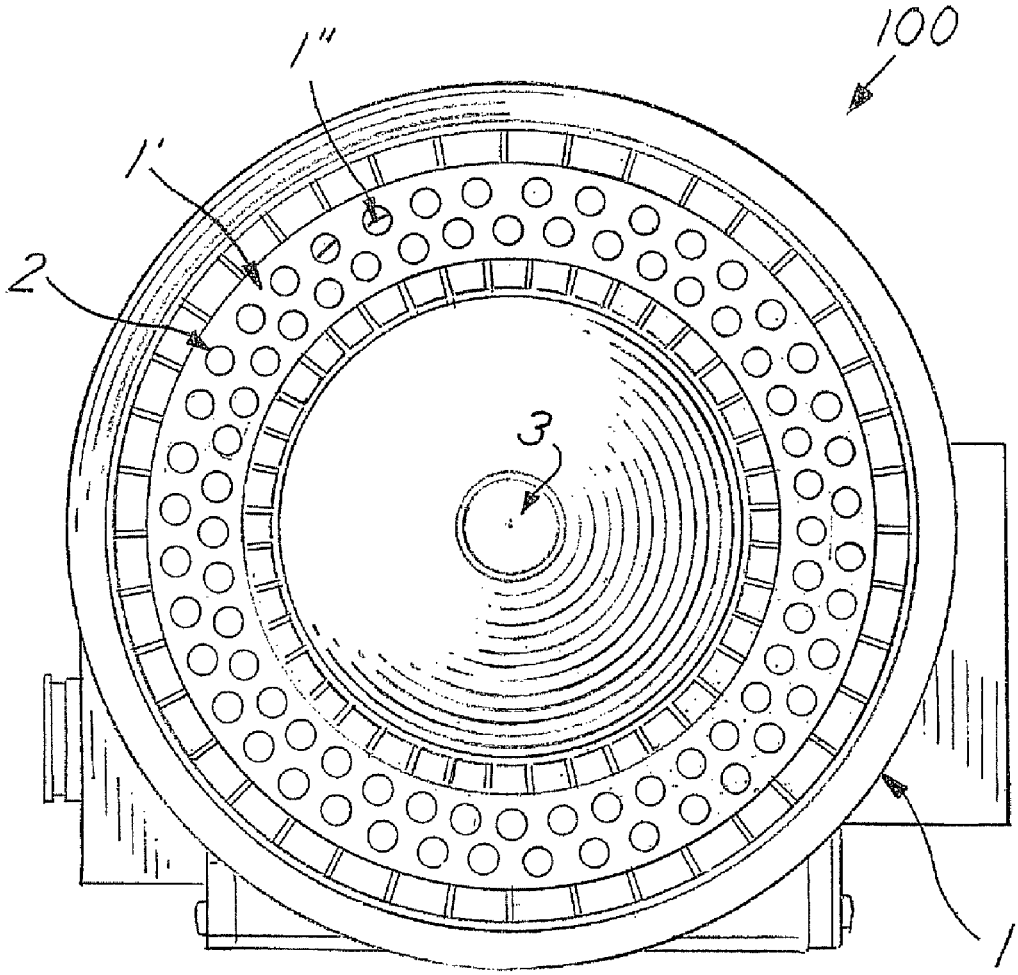
FIG. 2 shows a top plan view of the gaming device seen in FIG. 1.

Referring to FIGS. 1-2, a gaming device 100, provided with substantially spherical balls (e.g.; orbs), can rapidly generate a randomly selected set of the balls. Gaming device 100 includes a revolving cylinder (1), a double plate (1', 1") in, for example, two rows. Each of a plurality of holes (2) has its own position marked with an appropriate designation (e.g.; numerical, color, etc). Cylinder (1) has a plate that is raised towards the center and an opening (3) constructed in the center for the exhaust or exit of the balls. That plate is connected at the bottom of the device 100 to a ball launching chamber. A mechanism enables the ejection of the balls from the launching chamber. In one implementation, the launching mechanism comprises a ventilating fan (4) for the generation of an air current.

The balls have a weight and are made of a material (e.g.; Styrofoam, plastic) that enables the air current from ventilating fan (4) to shoot them over the cylinder (1).

Below the cylinder (1), the ball launching chamber is constructed so as to contain balls of two or more diameters or dimensions. The balls with the smaller diameter(s) are provided to better scattering all of the balls as well as to provide a greater attractiveness of the game. The balls with the largest diameter are the balls from which a randomly selected set thereof are drawn to arrive at a result of a game on the gaming device.

The basic dimension of the holes (2) in the plates (1', 1") is the same as the dimensions of the balls with the larger diameter. It is possible to mutually offset the position of the plates (1', 1") so that, in the case of mutual offset of plate (1") with respect to plate 1', an ball with a larger diameter will be retained in hole 2 of plate 1' while the balls of lesser diameter will fall through the holes (2) of both plates (1', 1"). By way of example, and not by way of limitation, a known stepping mechanism can be used to accomplishing this mutual offset for the position of the plates (1', 1"), where the offsetting mechanism can be formed in a central control spot. As such, the offset can be accomplished without having to manually reach into the gaming device 100 during play.

Following the ejection of all the balls (both larger and smaller diameters), the randomly selected set of larger diameter balls that are retained in the holes 2 of plate 1' can be read with the aid of sensors. Then, the stepping mechanism can be activated to remove the mutual offset of the position of the plates (1', 1") such that the randomly selected set of larger diameter balls that are retained in the holes 2 of plate 1' will drop through the double plates (1', 1") and fall into the ball launch chamber where they wait for the next new game cycle or game to be played on gaming device 100. In this manner, gaming device 100 can quickly be immediately ready for a new game.

While preferred embodiments of this invention have been shown and described, modifications thereof can be made by one skilled in the art without departing from the spirit or teaching of this invention. The embodiments described herein are exemplary only and are not limiting. Many variations and modifications of the method and any apparatus are possible and are within the scope of the invention. One of ordinary skill in the art will recognize that the process just described may easily have steps added, taken away, or modified without departing from the principles of the present invention. Accordingly, the scope of protection is not limited to the embodiments described herein, but is only limited by the claims that follow, the scope of which shall include all equivalents of the subject matter of the claims.

What is claimed is:

1. A method for use in a gaming apparatus for selecting a random set of balls used to determine at least a part of an outcome of a game, comprising:

(a) providing top and bottom plates that are vertically spaced apart along a common central axis, with at least one of said plates being rotatable relative to the other, (b) providing in said top plate a plurality of vertical holes that extend through said plate and are transversely spaced apart from each other in a predetermined pattern, with each hole having the same diameter H about its central axis, and where said bottom plate has the same pattern of holes of diameter H extending vertically through the bottom plate, each of said holes in said top plate having a symbol associated with a designation, (c) providing a plurality of large balls of diameter D which is smaller than hole diameter H, and a plurality of small balls of diameter d which is less than diameter D, (d) rotating one of said plates relative to the other about their common central axis to an offset position, such that the central axis of each of said holes in said top plate is partially offset from the central axis of the corresponding hole in the bottom plate, whereby a vertical passage of diameter p is defined through each pair of vertically adjacent holes in said top and bottom plates, where diameter p is greater than small ball diameter d and less than large ball diameter D, (e) directing a plurality of said large balls and a plurality of said small balls to a region atop said top plate, where at least some of said large and small balls can roll at the same time on said top surface, and where said small balls atop said top plate will fall into said holes in said top plate and fall through said passages of diameter p which is greater than small ball diameter d, and said large balls atop said top plate will fall partially into said holes in said top plate and will be blocked from falling further through said passage p of diameter less than large ball diameter D, and (f) determining the outcome of at least part of the game based the set of designations associated with each hole in said top plate in which a large ball is restrained from falling through a passage.

2. The method according to claim 1 comprising the further step (g) of rotating one of said plates relative to the other to a non-offset position where each hole in said top plate is vertically and concentrically aligned with a corresponding hole in the bottom plate, to thus define a vertical passage of diameter P equal to the diameter H of said top and bottom plate holes, thereby allowing said large balls restrained from falling through said passages in said offset position, to fall through both plates.

3. The method according to claim 2 comprising the steps of sequentially repeating said steps (c) through (g).

4. The method according to claim 1 comprising the further step of determining with sensors the presence of each large ball that is restrained in said offset position of said plates.

5. The method according to claim 1 comprising the further steps, providing in said apparatus a supply of said large and small balls, and in said offset position of said plates, ejecting a plurality of said large and small balls from said supply onto the top surface of said top plate, where they roll randomly to said holes in said top plate.

6. The method according to claim 2, comprising the further step of directing said small and large balls which have fallen through said passages back to said supply for re-use.

7. The method according to claim 5 comprising the step of using air flow to eject said balls from said supply onto said top plate.

8. The method according to claim 5 of directing said balls through a coaxial hole extending through said top and bottom plates.

9. The method according to claim 2 comprising the further step of providing a rotation drive that rotates one of said plates relative to the other between said non-offset and offset positions.

10. The method according to claim 9, comprising the further step of providing with said rotation drive a stepping mechanism to rotate said one plate step-wise between said non-offset and offset positions without manual intervention during play of a sequence of games.

11. A method for use in a gaming apparatus for selecting a random set of balls used to determine at least a part of an outcome of a game, comprising:

(a) providing top and bottom plates that are vertically spaced apart along a common central axis, with at least one of said plates being rotatable relative to the other, (b) providing in said top plate a plurality of holes that extend vertically through said plate and are transversely spaced apart from each other in a predetermined pattern, with each hole having the same diameter H about its central axis, and where said bottom plate has the same pattern of holes of diameter H extending vertically through the bottom plate, (c) providing a plurality of large balls each having diameter D which is smaller than hole diameter H, and a plurality of small balls each having diameter d which is less than diameter D, (d) applying an identifying designation to all said large balls, (e) rotating one of said plates relative to the other about their common central axis to an offset position, such that the central axis of each of said holes in said top plate is partially offset from the central axis of the corresponding hole in the bottom plate, whereby a vertical passage of diameter p is defined through each pair of vertically adjacent holes in said top and bottom plates, where diameter p is greater than small ball diameter d and less than large ball diameter D, (f) directing a plurality of said large balls and a plurality of said small balls to a region atop said top plate, where at least some of said large and small balls can roll at the same time on said top surface, and where said small balls atop said top plate will fall into said holes in said top plate and fall through said passages of diameter p greater than small ball diameter d, and said large balls atop said top plate will fall partially into said holes in said top plate and will be blocked from falling further through said passage p of diameter less than large ball diameter D, and (g) determining the outcome of at least part of the game based the set of designations associated with the large balls restrained at said passages p.

12. A method for use in a gaming apparatus for selecting a random set of balls used to determine at least a part of an outcome of a game, comprising:

(a) providing top and bottom plates that are vertically spaced apart along a common central axis, with at least one of said plates being rotatable relative to the other, (b) providing in said top plate a plurality of holes that extend vertically through said plate and are transversely spaced apart from each other in a predetermined pattern, with each hole having the diameter H about its central axis, and where said bottom plate has the same holes of diameter H extending vertically through the bottom plate, each of said holes in said top plate associated with a designation, (c) providing a plurality of large balls each having diameter D which is smaller than hole diameter H, and a plurality of small balls each having diameter d which is less than diameter D, (d) rotating one of said plates relative to the other about their common central axis to an offset position, such that the central axis of each of said holes in said top plate is partially offset from the central axis of the corresponding hole in the bottom plate, whereby a vertical passage of diameter p is defined through each pair of vertically adjacent holes in said top and bottom plates, where diameter p is greater than small ball diameter d and less than large ball diameter D, (e) directing a plurality of said large balls and a plurality of said small balls to a region atop said top plate, where at least some of said large and small balls can roll at the same time on said top surface, and where said small balls atop said top plate will fall into said holes in said top plate and fall through said passages of diameter p which is greater than small ball diameter d, and said large balls atop said top plate will fall partially into said holes in said top plate and will be blocked from falling further through said passage p of diameter less than large ball diameter D, and (f) determining the outcome of at least part of the game based on the set of designations with each hole in said top plate in which a large ball is restrained from falling through a passage.

* * * * *